United States Patent [19]

Galiakbarov et al.

[11] Patent Number: 4,842,066

[45] Date of Patent: Jun. 27, 1989

[54] METHOD FOR ISOLATION OF INTAKE BEDS IN DRILL HOLES AND A DEVICE FOR CARRYING SAME INTO EFFECT

[75] Inventors: Vil F. Galiakbarov; Rashit K. Sannikov; Midkhat R. Mavljutov, all of Ufa; Alexandr S. Fomin, Syktyvkar; Vladimir D. Baranovsky, Moscow; Radil A. Galiev, Ufa; Rinat G. Sedakov, deceased, late of Dudinka, all of U.S.S.R., by Tatyana Pavlovna Sedakova, Elvira Rinatovna Sedakova, Boris rinatovich Sedakov, administrators

[73] Assignee: Ufimsky Neftyanoi Institut, U.S.S.R.

[21] Appl. No.: 46,998

[22] Filed: May 5, 1987

[51] Int. Cl.[4] ..... E21B 7/00; E21B 33/138; E21B 43/38

[52] U.S. Cl. ..... 166/265; 166/286; 166/222; 166/242; 175/72; 175/424

[58] Field of Search ..... 166/265, 285, 286, 287, 166/177, 222, 223, 242; 175/72, 424

[56] References Cited

U.S. PATENT DOCUMENTS

| | | | |
|---|---|---|---|
| 1,674,815 | 6/1928 | Barnhart | 166/265 X |
| 1,994,850 | 3/1935 | Burt | 166/222 |
| 1,998,833 | 4/1935 | Crowell | 166/177 X |
| 2,072,982 | 3/1937 | Dale | 166/177 X |
| 2,117,537 | 5/1938 | Baker | 166/222 |
| 2,257,765 | 10/1941 | Scaramucci | 166/222 |
| 2,642,268 | 6/1953 | Armentrout | 175/72 |
| 2,776,111 | 1/1957 | Vance | 166/177 X |
| 2,890,169 | 6/1959 | Prokop | 175/72 X |
| 3,072,195 | 1/1963 | Kluck | 166/177 X |
| 3,409,093 | 11/1968 | Cunningham et al. | 175/72 X |

FOREIGN PATENT DOCUMENTS 1055856 11/1983 U.S.S.R. .

*Primary Examiner*—George A. Suchfield
*Attorney, Agent, or Firm*—Ladas & Parry

[57] ABSTRACT

There is claimed a method for isolating intake beds in drill holes (wells), wherein a cement slurry is pumped into a drill pipe string from a well mouth and flash setting and thickening of the cement slurry is ensured once it has left the drill pipe string and a separated phase of lower density is directed to the well mouth via an annular space of the well above a lost circulation zone. A device for carrying same into effect is also claimed.

6 Claims, 2 Drawing Sheets

METHOD FOR ISOLATION OF INTAKE BEDS IN DRILL HOLES AND A DEVICE FOR CARRYING SAME INTO EFFECT

FIELD OF THE INVENTION

The present invention relates to mining, and more particularly it relates to methods of isolating intake beds in drill wells and to devices for carrying the aforesaid methods into effect.

The invention can find application in drilling for oil and gas in the mining and oil producing industries.

BACKGROUND OF THE INVENTION

There is widely known a method of isolating intake beds in deep wells (cf. e.g. Text "Isolation of Intake Beds in Deep Wells", by V. I. Krylov, Nedra Publishers, Moscow, 1980, pp. 258–259), wherein a cement slurry is pumped to a drill pipe string from a wellhead. Filling and thickening agents or cement setting accelerators are transported together with the cement slurry in polyethylene or rubber containers. Once the cement slurry has left the drill pipe string, the sheathing of the container is slit with the aid of knives, and additional components are thereafter introduced into the cement slurry to provide for flash setting and thickening.

The cement setting accelerators change rheological and structural-strength properties of the cement slurry not instantly but rather within a certain period of time, which causes the cement slurry flowing in the hole below drill pipes and in the lost-circulation formation to be inevitably mixed with drilling mud in the hole and with formation fluid in the lost-circulation formation since it enters the latter mostly through its well-drained channels. The cement slurry essentially losses its plugging properties, thus adversely affecting the quality of isolation of intake beds in drill holes (or wells).

There is further known a method of well cementing (cf. e.g. USSR Inventor's Certificate No. 1,055,856), wherein a well is first washed and thereafter a cement slurry is pumped into a drill pipe string from a wellhead, after which flash setting and thickening of the cement slurry is ensured with phases of higher and lower densities obtained by centrifugal separation of the cement slurry once it has left the drill pipe string. With a rotary motion imparted, the cement slurry enters the annular space. When flowing up to the wellhead, the rotating cement slurry flow gains an additional momentum. It has the highest rotation speed in the zone of minimum annular section between the well wall and the maximum outer diameter of the separator. This results in excess pressure being exerted on the well walls. As a result, the phase of higher density is again involved in intensive mixing with that of lower density, thus affecting isolation of intake beds. The most intensive mixing of the phases of higher and lower densities occurs when isolating highly permeable intake beds.

There is also known a device for well cementing (SU, A No. 1,055,856), comprising a housing connected with a lower end of the drill pipe string by means of an adapted and having an axial passage and at least a single lateral circulation duct for separating the cement slurry. The circulation duct is provided on the outside surface of the housing in a spiral and connects the axial passage with an annular space, wherein the cement slurry undergoes centrifugal separation. The housing is likewise provided with a case, whose outside surface above the lateral circulation duct is a paraboloid of revolution with a cross-section increasing upwards.

For effective rotation of the cement slurry flow it is necessary to provide a considerable pressure drop across the spiral circulation ducts, for which the ducts must be long enough and have a small cross-section. This is fairly difficult to achieve and involves hazard in isolating intake beds. In addition, more stringent demands are consequently to be placed on cementing equipment (pressure piping of a drillsite, drill pipe string).

The cross-section of the cement slurry flow noticeably decreases in the annular channel, gradually narrowing upwards, between the well walls and the casing made as a paraboloid of revolution, which gives rise to high turbulization of the flow hampering centrifugal separation of the cement slurry. In addition, a smaller cross-section of the upward flow of the cement slurry in the annular space leads to higher pressure exerted on a lost-circulation formation, which restricts the possibility of ensuring higher rotation speed of the cement slurry, in particular, when isolating highly permeable intake beds and promotes downward movement of the lower density phase followed by penetration of this phase into the intake bed and mixing with the phase of higher density.

In the case of an embodiment of the device with a single circulation duct, no dynamic balancing is carried out, which fails to provide a stable concentric position of the device in a drill well.

SUMMARY OF THE INVENTION

It is an object of the present invention to provide a method for isolating intake beds in drill holes and a device for carrying same into effect with such a removal of one of the cement slurry phases which would provide for more effective isolation of intake beds.

This is attained by a method for isolating intake beds in drill wells, wherein a cement slurry is pumped into a drill pipe string from a hole mouth and flash setting and thickening of the cement slurry is ensured with phases of higher and lower densities obtained by centrifugal separation of the cement slurry once it has left the drill pipe string, characterized in that the separated phase of lower density is directed to the hole mouth via an annular space of the hole above a lost circulation zone.

The foregoing and other objects are also accomplished due to the fact that in a device for carrying into effect the method for isolating intake beds in drill wells, comprising a housing connected with a lower end of the drill pipe string by means of an adapter and having passages on its lateral surface for circulation of the cement slurry, according to the invention, the housing has an upper portion as a diffuser with cylindrical portions at its ends and a lower cylindrical portion, in the lower end of which there is provided coaxially with the housing a connecting pipe with a tip, said passages of spiral-tangential shape for circulation of the cement slurry being evenly spaced circumferetially in the lower cylindrical portion of the diffuser, whereas the upper cylindrical portion of the diffuser accommodates an opening, wherein there is located a bent end of a branch pipe coaxial with the housing and connected with the pipe.

It is advisable that diameters $D_1$, $D_2$, $D_3$ respectively of the lower portion of the housing, the upper cylindrical portion of the diffuser, and the adapter have the following ratio: $D_2 < D_3 < D_1$ so as to improve passage conditions of the upward flow of the lower density phase and to prevent it from penetrating into the intake bed.

It is also reasonable that vertical guide strip be provide on the outside cylindrical surface of the adapter so as to further improve passage conditions of the upward flow of the lower density phase.

The application of the present invention makes it possible to provide a fairly simple and yet effective isolation of intake beds, in particular, zones of difficult lost circulation when drilling in heterogeneous fissured-cabernous rocks featuring high water permeability.

BRIEF DESCRIPTION OF THE DRAWINGS

In what follows the present invention will now be disclosed in a detailed description of an illustrative embodiment of the method for isolating intake beds in drill wells and the device for carrying same into effect with reference to the accompanying drawings, wherein.

DETAILED DESCRIPTION OF THE INVENTION

Figure 1:
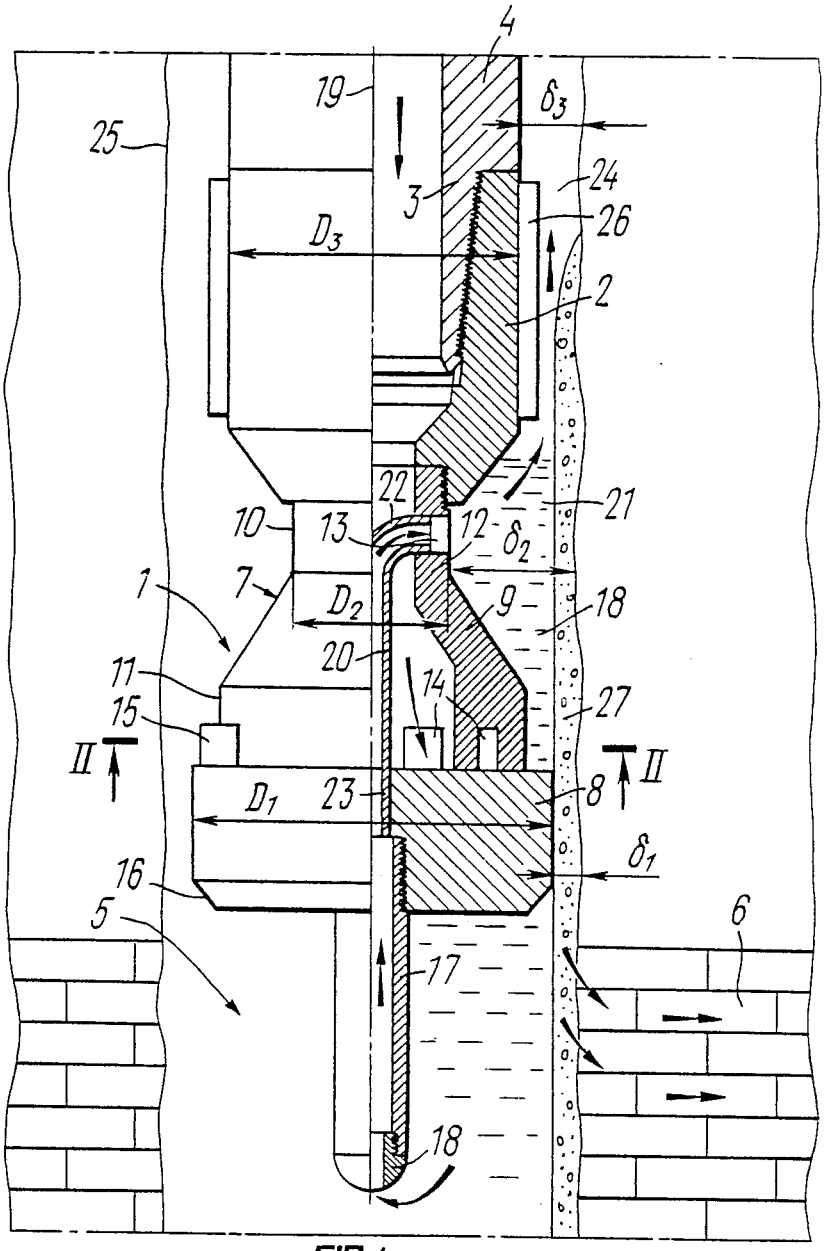
FIG. 1 is a general schematic view of a device for isolation of intake beds in drill wells showing a fragmentary longitudinal section, according to the invention.

The method for isolation of intake beds in drill holes is carried into effect by a device, comprising a housing 1 (FIG. 1) connected by means of an adapter 2 with a lower end 3 of the drill pipe string 4 located in a hole 5 on the level of a lost-circulation formation 6. The housing 1 has an upper portion 7 and a lower cylindrical portion 8. The upper portion 7 of the housing 1 is in fact a diffuser 9 with two cylindrical portions 10, 11 respectively in the upper and lower ends of the diffuser 9. An opening 13 is provided on a side wall 12 of the upper cylindrical portion 10. Provided on the side wall of the lower cylindrical portion 11 are passages 14 (FIGS. 1, 2) of spiral-tangential shape for circulation of the cement slurry evenly spaced circumferentially on the portion 11. The outside surface of the lower cylindrical portion 11 carries guide lips 15 at the outlet end of the passages 14.

The diffuser 9 (FIG. 1) with the passages 14 for circulation of the cement slurry and the guide lips 15 is a separation unit.

Provided on the outside surface of the lower cylindrical portion 8 of the housing 1 is a chamfer 16, which facilitates passage of the device in the hole or well 5. The lower end of the portion 8 of the housing 1 accommodates a connecting pipe 17 with a tip 18 arranged coaxially with a line 19 of the housing 1. The device also comprises a branch pipe 20 for ejecting a cement slurry phase 21 of lower density, its bent end 22 being located in the opening 13 and the other end 23 being connected with the pipe 17.

The lower portion 8 of the housing I with the connecting pipe 17, the tip 18, and the branch pipe 20, whose bent end runs through the opening 13 of the upper cylindrical portion 10 of the diffuser 9 is an ejection unit.

The inner diameters $d_1$, $d_2$, $d_3$ respectively of the connecting pipe 17, the tip 18, and the branch pipe 20 have the following ratio: $d_1 > d_3 > d_2$.

This ratio provides a required degree of cement slurry separation, an adequate ejection effect, a minimum hydraulic resistance when ejecting drilling mud from the hole 5 at the beginning of the isolation process, the phase 21 of lower density and formation fluid, flowing into the hole 5 from the lost-circulation formation 6 mostly from the central zone of the hole 5 below the device, into an annular space 24 above the lost-circulation formation 6.

The outer diameter $D_3$ of the branch pipe 20 is determined by the appropriate flow section for the movement of the cement slurry via the inner space of the upper cylindrical portion 10 of the diffuser 9 in the direction of the sprial-tangential passages 14.

The outer diameters $D_1$, $D_2$, $D_3$ respectively of the lower portion 8 of the housing 1, the upper cylindrical portion 10 of the diffuser 9, and the adapter 2 have the following ratio: $D_2 < D_3 < D_1$.

This ratio is determined so that radial clearances $\delta_1$, $\delta_2$, $\delta_3$ between a wall 25 of the hole 5 and respectively the outside surface of the lower portion 8 of the housing 1, the upper cylindrical portion 10 of the diffuser 9, and the adapter 2 would provide a required annular space for separating the cement slurry and providing low pressure in the radial opening 13 of the upper cylindrical portion 10 of the diffuser 9 for ejecting fluid in the hole 5 below the device and blocking the downward movement of the phase 21 of lower density through the radial clearance $\delta_1$ to the lost-circulation formation 6.

To improve passage conditions of the upward flow of the phase 21 of lower density to the mouth of the hole 5, provision is made for vertical guide strips 26 located on the outside cylindrical surface of the adapter 2.

The method for isolation of intake beds in drill holes is as follows.

Cement mixers (not shown in the drawing) are employed for making a cement slurry using cement and water in the area of the well 5 mouth, which is delivered from the hole 5 mouth into the drill pipe string 4 by means of cementing unit pumps (not shown in the drawing). The cement slurry flows via the drill pipe string 4, the upper portion 7 and the lower portion 8 of the housing 1 of the device. The cement slurry flows at a high speed via the circulation passages 14 and the guide lips 15 (FIG. 2) rotating intensively in the annular space 24 (FIG. 1) between the outside walls of the diffuser 9 and walls 25 of the hole 5. Under the action of centrifugal force the particles of a solid phase 27 of the cement slurry, whose density far exceeds that of the liquid phase 21, for instance water, are removed towards the periphery of the annular space 24 to the walls 25 of the hole 5. The liquid phase 21 mostly occupies an area adjacent to the outside walls of the diffuser 9. Concentration of cement in the slurry increases as its rotation radius grows.

Figure 2:
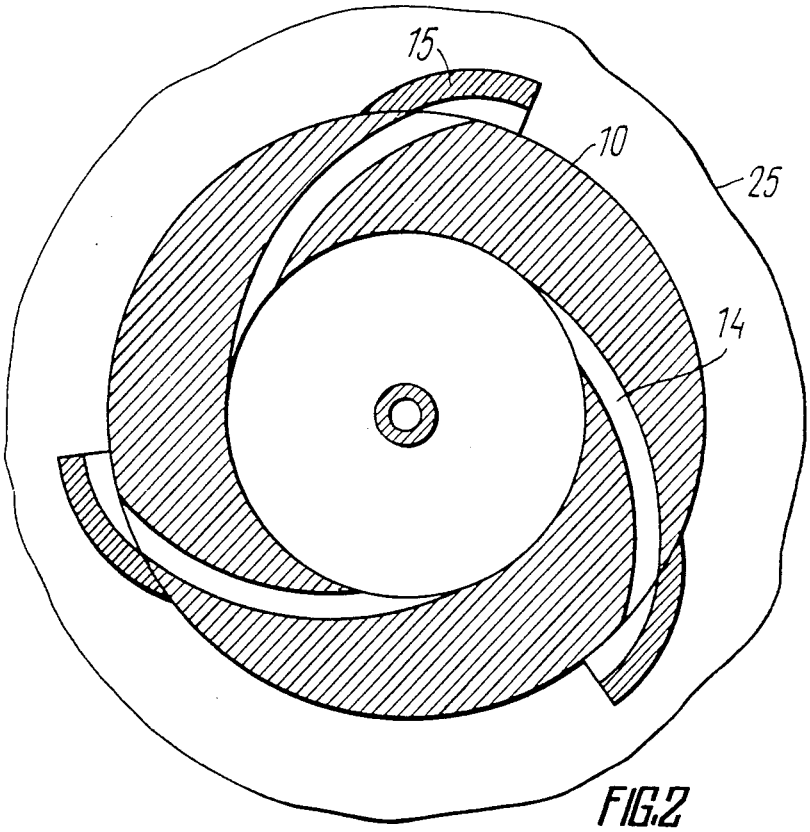
FIG. 2 is a cross section on line II—II in FIG. 1 according to the invention.

The phase 27 of the cement slurry of higher density is located near the walls 25 of the hole 5 as a layer, a cement layer on the wall 25 of the hole 5 as shown for clarity in FIG. 1. The phase 27 of higher density flows by gravity via the annular clearance $\delta_1$ between the outside surface of the lower portion 8 of the housing 1 and the walls 25 of the well 5 downwards into the lost-circulation formation 6 (shown by arrows) and being quick-setting by nature, is not practically mixed with formation fluid.

Thus, flash setting and thickening of the cement slurry takes place.

The layer of the phase 21 of lower density is driven to the annular space 24 above the diffuser 9.

With the cement slurry rotating intensively in the annular space 24 of the well 5, a low-pressure zone is provided in the area of the opening 13 of the upper cylindrical portion 10 of the diffuser 9, which results in the separated phase 21 of lower density being directed to the hole 5 mouth via the annular space 24 of the hole 5 above the lost circulation zone 6.

At the beginning of isolation of the lost-circulation formation 6, drilling mud and formation fluid are ejected, as described hereinabove, to be mixed with the phase 27 of higher density. Subsequently, the phase 21 of lower density is ejected along the guide strips 26 to the well 5 mouth.

With the phase 21 of lower density flowing downwards via the annular clearance $\delta_1$, it occupies the central portion of the hole 5 due to intensive rotation and is inevitably ejected via the tip 18, the connecting pipe 17, the branch pipe 20, and the opening 13 of the upper cylindrical portion 10 of the diffuser 9 into the annular space 24 of the hole 5 above the lost-circulation formation 6 to the hole 5 mouth.

The cement slurry is not pratically mixed with drilling mud and formation fluid once it has left the device and in the zone where the cement slurry undergoes centrifugal separation, as well as in the lost-circulation zone and the lost-circulation formation proper. The cement slurry flow acquires elastic properties and excess pressure is exerted on the walls of the well 5, which contributes to more uniform frontal replacement of formation fluid by the flow. The effectiveness of isolating the lost-circulation formation 6 is determined by a degree of separation of the cement slurry with the phases 27, 21 of higher and lower densities respectively obtained and the phase 21 of lower density being ejected, which are characterized by separation and ejection coefficients respectively.

The possibility of adjusting separation and ejection coefficients as well as the rotation speed of the cement slurry flow and the excess pressure exerted on the hole walls makes the process of isolating intake beds controllable by adjusting parameters of the cement slurry delivered from the well 5 mouth.

The cement slurry may contain, apart from cement and water, inert fillers, cement setting accelerators, polymeric and other materials coagulating in the lost-circulation formation 6, in particular in plugging-back of lost circulation channels with an opening of 10 mm.

The separation coefficient is defined by:

$$K_1 = \frac{\rho_1 - \rho_2}{\rho_2 - \rho_3}, \tag{1}$$

where $\rho_1$ is density of original cement slurry, $\rho_2$ is density of the ejected phase 21 of lower density, $\rho_3$ is density of make-up water.

The ejection coefficient of the phase 21 of lower density is defined by:

$$K_2 = Q_2/Q_1, \tag{2}$$

where $Q_1$ is flow rate of cement slurry delivered from the hole 5 mouth, $Q_2$ is flow rate of ejected cement slurry.

With a specified diameter of the hole 5 and characteristics of the lost-circulation formation 6, the separation and ejection coefficients depend on diametral dimensions of the separation and ejection units, density of the original cement slurry, flow rate of the cement slurry delivered from the hole 5 mouth and are determined experimentally.

The characteristics of the lost-circulation formation include its thickness, distribution of channels in thickness, channel opening, and specific bed intake determined by $\Delta Q/Ph$, where $\Delta Q$ is flow rate in the lost-circulation formation, P is well pressure, and h is thickness of the lost-circulation formation.

With the separation and ejection coefficients known, the density of the higher density phase ($\rho_4$) obtained as a result of centrifugal separation is defined by:

$$\rho_4 = \frac{1 - K_2[1 - K_1(1 - \beta)]}{1 - K_2}\rho_1, \tag{3}$$

where $$\beta = \frac{\alpha + m_1}{1 + m_1}; \tag{4}$$

$$\alpha = \frac{\rho_3}{\rho_5}; \tag{5}$$

$m_1$ is water-cement ratio of original cement slurry; $\rho_5$ is density of dry cement.

The density of the original cement slurry ($\rho_1$) is defined by:

$$\rho_1 = \frac{(1 + m_1)\rho_6\rho_5}{\rho_3 + m_1\rho_5} \tag{6}$$

The parameters of the device, water-cement ratio, and density of the original cement slurry are determined as a function of hole 5 diameter and characteristics of the lost-circulation formation 6.

The geometric dimensions of the device, the number and diameter of the spiral-tangential passages 14 of the diffuser 9, flow rate of the cement slurry delivered from the well 5 mouth, as well as separation and ejection coefficients are determined depending on hole 5 diameter and characteristics of the lost-circulation formation 6. The relationship between $k_1$ and $K_2$ coefficients and cement flow rate $Q_1$ is established experimentally.

An appropriate water-cement ratio $m_2$ of the higher density phase is chosen on the basis of characteristics of the lost-circulation formation 6 provided that the cement slurry does not penetrate deep into the lost-circulation formation 6 and a reliable watertight barrier is ensured. For instance, with $m_2=0.2$, a thick quick-setting paste is formed using almost all types of oil-well cements.

The density of the higher density phase 27 is defined by:

$$\rho_4 = \frac{(1 + m_2)\rho_3\rho_5}{\rho_3 + m_2\rho_5} \tag{7}$$

The required density ($\rho_1$) of the original cement slurry is defined by formula (3):

$$\rho_1 = \frac{1 - K_2}{1 - K_2[1 - K_1(1 - \beta)]} \tag{8}$$

The water-cement ratio ($m_1$) of the original cement slurry is defined by formula (6):

$$m_1 = \frac{(\rho_5 - \rho_1)\,\rho_3}{(\rho_1 - \rho_3)\,\rho_5} \quad (9)$$

Excess pressure ($p_1$) exerted on the hole 5 walls determined by the rotating cement slurry flow is defined by:

$$\rho_1 = \frac{Q_1 \rho_1}{2n^2 s^2}, \quad (10)$$

wherein n and S are respectively the number and the cross-sectional area of the spiral-tangential passages 14 for cement slurry circulation.

EXAMPLE

In carrying into effect the method for isolating intake beds, the following parameters were measured: with the flow rate ($Q_1$) of the cement slurry delivered from the wellhead being 0.01 $m^3/s$, the flow rate ($Q_2$) of the cement slurry ejected to the wellhead is 0.004 $m^3/s$ as measured with a volumetric method. The cement slurry was made of Portland cement with a density ($\rho_5$) of 3,050 $kg/m^3$ and a water-cement ratio ($m_1$) of 0.5. The density ($\rho_3$) of make-up water is 1,000 $kg/m^3$. The density ($\rho_1$) of the original cement slurry is 1,800 $kg/^3$. The density ($\rho_2$) of the ejected cement slurry measured by a hydrometer is 1,350 $kg/m^3$.

Separation and ejection coefficients ($K_1=0.5625K_2=0.4$) were obtained from formulae (1) and (2) respectively.

To isolate a particular lost-circulation formation, it is necessary to ensure that a cement slurry has a 0.25 water-cement ratio ($m_2$).

The density of the cement slurry with $m_2=0.25$ is defined by formula (7):

$\rho_4=2{,}163$ $kg/m^3$ $\alpha=0.3279$ and $\beta=0.5519$ are by formulae (5) and (6).

The required density ($\rho_1=1{,}854$ $kg/m^3$) of the original cement slurry is obtained from formula (8).

The original cement slurry must be prepared with a water-cement ratio ($m_1=0.46$) as per formula (9).

Excess pressure exerted on the hole walls determined by the rotating cement slurry flow is $P=1.37$ MPa with a hole diameter $D=0.1905$ m, the number of passages for cement slurry circulation $n=2$, the passage cross-sectional area $S=1.77\cdot10^{-4}$ $m^2$, the cement flow rate $Q_1=0\text{–}01$ $m^3/s$, and the density of the original cement slurry $\rho_1=1{,}900$ $kg/m^3$.

When employing the aforesaid method for isolating intake beds in drill holes, there is provided a more homogeneous cement slurry with a minimum liquid phase content, which leads to the formation of the homogeneous cement stone featuring low permeability, high strength and plasticity and having few fine pores under the conditions of a limited contact with formation fluid in the intake bed. The method ensures that drilling mud and sludge are effectively driven from the borehole wall area and caverns, which results in higher quality and effectiveness of isolation of thick intake beds, wherein there is a loss of circulation at the bottom of the intake bed and the cement slurry is mixed with formation fluid driven from the top of the intake bed. The device for carrying the aforesaid method into effect is simple in design, small in size, easy to manufacture, and reliable in operation.

The method makes it possible to simplify the process of isolating intake beds, bring down the cost of materials involved by 2 to 3 times, and save time by 2 to 5 times.

We claim:

1. A method for isolation of intake beds in drill holes, wherein an original cement slurry is pumped into a drill pipe string from a hole mouth, flash setting and thickening of the cement slurry is ensured with phases of higher and lower densities obtained by centrifugal separation of the cement slurry once it has left the drill pipe string the higher density phase of the cement slurry being directed to the intake bed to harden and the separated phase of lower density is directed to the hole mouth via an annular space of the hole above a lost circulation zone.

2. A device for carrying into effect a method for isolating intake beds in drill holes, comprising:

an adapter;

a housing connected with a lower end of the drill pipe string by means of said adapter;

an upper portion of said housing, which is in fact a diffuser;

upper and lower cylindrical portions of said diffuser provided at the upper and lower ends of said diffuser;

passages of spiral-tangential shape for circulation of the cement slurry evenly spaced circumferetially in said lower cylindrical portion of the diffuser;

an opening provided in said upper cylindrical portion of the diffuser;

a lower cylindrical portion of said housing welded to the lower portion of the diffuser and having a lower end;

a connecting pipe installed in a hole coaxial with the lower end of said lower cylindrical portion of the housing;

a branch pipe coaxially arranged within said housing, one end of said branch pipe being bent and located in said opening of the upper cylindrical portion of the diffuser and the other end of said branch pipe being connected with said pipe.

3. A device as claimed in claim 2, wherein said lower portion of the housing, upper cylindrical portion of the diffuser and adapter respectively have an outer diameter $D_1$, $D_2$, $D_3$, said outer diameters being in the following ratio: $D_2<D_3<D_1$.

4. A device as claimed in claims 2, comprising vertical guide strips provided on the outside cylindrical surface of said adapter.

5. The method, as in claim 1 wherein the original cement slurry has a water-cement ratio of 0.46.

6. The method, as in claim 1 wherein the water-cement ratio of the higher density phase of the cement slurry is 0.25.

* * * * *